United States Patent [19]

Mayling

[11] Patent Number: 4,660,230

[45] Date of Patent: Apr. 28, 1987

[54] BASEBALL BATTING HELMET

[75] Inventor: Rudolf M. Mayling, Wallkill, N.Y.

[73] Assignees: Walter G. Weissenberger, Chappaqua; William H. Dippert, Briarcliff Manor, both of N.Y. ; a part interest to each

[21] Appl. No.: 875,182

[22] Filed: Jun. 17, 1986

Related U.S. Application Data

[63] Continuation-in-part of Ser. No. 628,741, Jul. 9, 1984, abandoned.

[51] Int. Cl.[4] ..... A42B 3/00

[52] U.S. Cl. ..... 2/413; 2/422; 2/425

[58] Field of Search ..... 2/413, 411, 412, 422, 2/410, 195, 425, 2

[56] References Cited

U.S. PATENT DOCUMENTS

| | | | |
|---|---|---|---|
| 1,305,895 | 6/1919 | Gibbons | 2/413 |
| 2,121,702 | 6/1938 | Larkin | 2/413 |
| 3,435,460 | 4/1969 | Grant | 2/422 |
| 3,866,909 | 2/1975 | De Santis | 2/411 X |
| 3,872,511 | 3/1975 | Nichols | 2/413 |
| 4,124,904 | 11/1978 | Matthes | 2/413 |
| 4,324,005 | 4/1982 | Willis | 2/413 |
| 4,547,919 | 10/1985 | Wang | 2/413 X |

*Primary Examiner*—Peter Nerbun

*Attorney, Agent, or Firm*—Hammond & Littell, Weissenberger & Dippert

[57] ABSTRACT

This invention is directed to an improved baseball helmet. More particularly, this invention is directed to an improved baseball batting helmet comprising an outer shell which projects over at least one of a batter's ears and has webbing and/or padding on the interior side of the shell to cushion the helmet against the batter's head and having an outer member adjacent to at least one side of the helmet, an impact-release member being positioned between the outer surface of the shell and the inner surface of the outer member.

10 Claims, 7 Drawing Figures

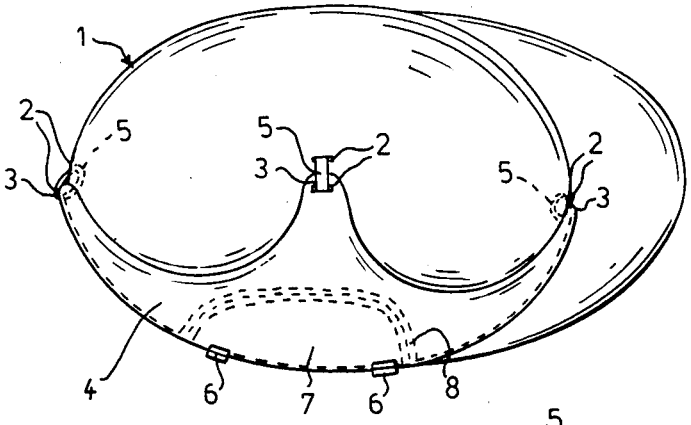
FIG.1
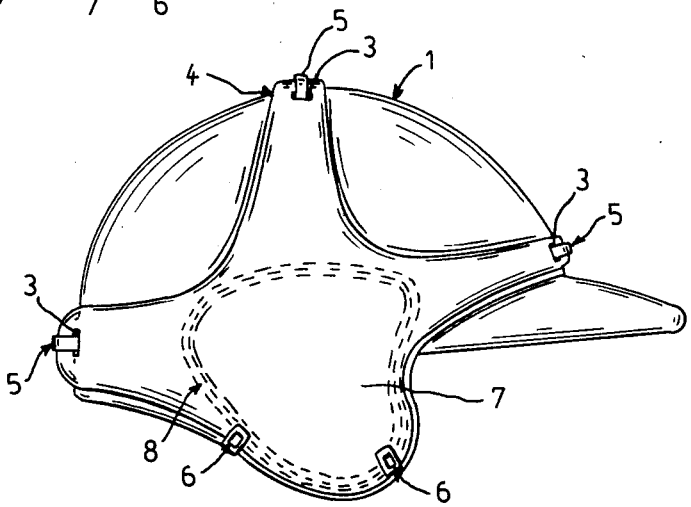
FIG.2
FIG.3
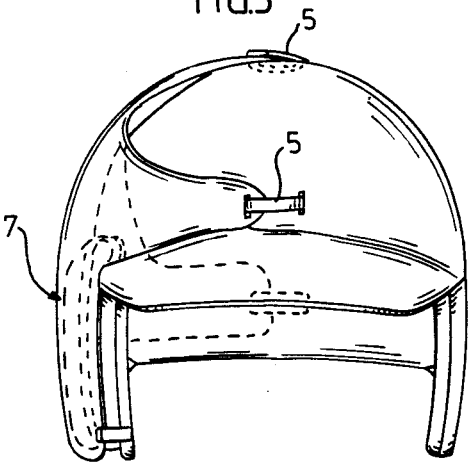
FIG.4
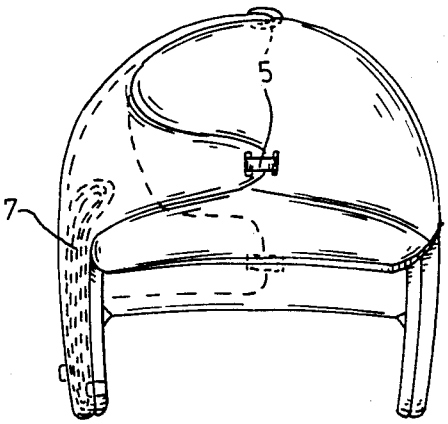

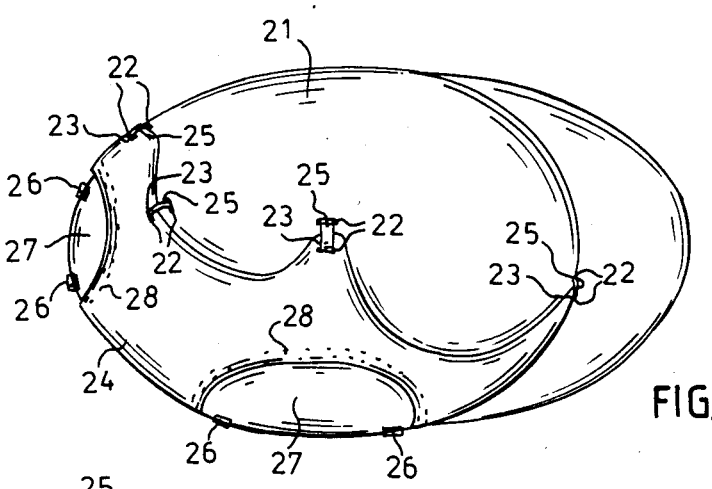
FIG.5
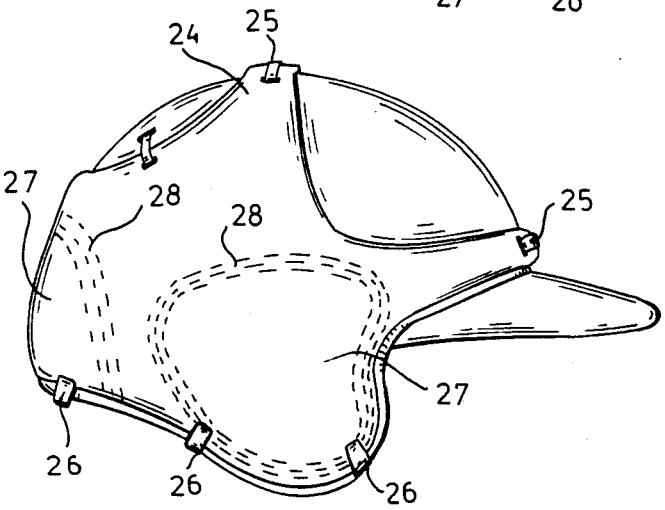
FIG.6
FIG.7
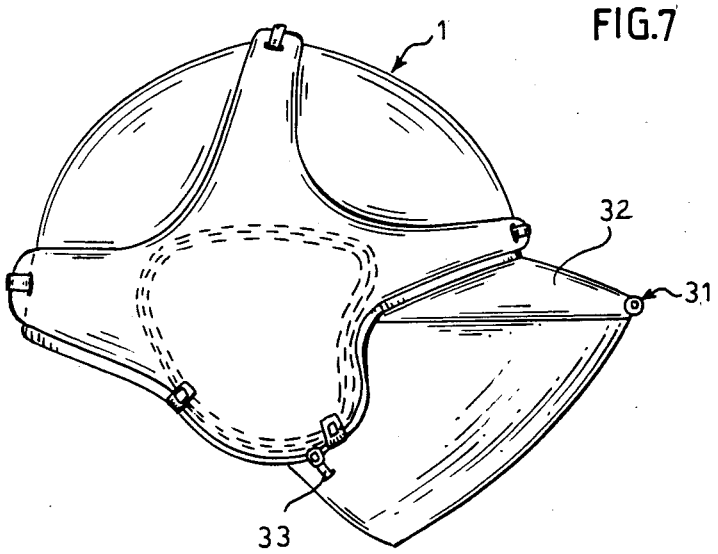

BASEBALL BATTING HELMET

CROSS-REFERENCE TO RELATED APPLICATION

This application is a continuation-in-part of co-pending U.S. patent application Ser. No. 628,741, filed July 9, 1984 now abandoned.

FIELD OF THE INVENTION

This invention is directed to an improved baseball helmet. More particularly, this invention is directed to a baseball batting helmet having an impact-release means located adjacent to the ear of a batter that faces the pitcher.

BACKGROUND OF THE INVENTION

It is well known in baseball, particularly in "hardball", where a small, hard baseball is used, that batters hit in the head with a baseball may suffer severe injury. To minimize such injury, various batting helmets are now in use. For the most part, such batting helmets comprise a plastic shell that is worn atop a batter's normal uniform cap or in place of the normal uniform cap. Such helmets may have a projection on one side or the other, dependent upon whether a batter is batting right-handedly or left-handedly, which projection substantially covers the ear of the batter which would face the pitcher.

The known batting helmets have provided minimally adequate protection for batters. However, there has been a serious need for a batting helmet which would more effectively protect the batter from the consequences of being hit by a baseball.

BRIEF DESCRIPTION OF THE DRAWINGS

FIG. 1 represents a slightly oblique, top view of an embodiment of the invention;

FIG. 2 represents a lateral view of the embodiment of FIG. 1;

FIGS. 3 and 4 represent a frontal view of the embodiment of FIG. 1;

FIG. 5 represents a slightly oblique, top view of an additional embodiment of the invention;

FIG. 6 represents a lateral view of the embodiment of the invention of FIG. 5; and FIG. 7 represents a lateral view of a further embodiment of the invention.

DETAILED DESCRIPTION OF THE INVENTION

Applicant has developed an improved baseball batting helmet which is much more effective than known batting helmets in protecting a batter from injury. According to Applicant's invention, an element corresponding to a typically known batting helmet is provided with a "floating" side member which substantially corresponds to the projection over the batter's ear. The side member is attached in a non-rigid manner to the main helmet and has an impact-release member between the side member and the helmet.

The impact-release member may comprise any suitable arrangement which is capable of absorbing and/or releasing and/or dispersing the forces resulting from the impact of an object such as a baseball. In a preferred aspect of the invention, said member comprises a fluid-filled sac which ruptures at the time of impact.

The sac may have virtually any desired shape, an approximately heart-shaped or oval sac being preferred, especially one of sufficient size to cover the ear and temple area of the batter. The cross-sectional area of the sac will vary according to the particular design employed and it is likely that said cross-sectional area will vary from about 2 to 40 $in^2$. Also, it should be noted that the impact-release member could comprise two or more individual sacs. For example, dependent upon the particular design employed, it may be advantageous to use from 2 to 10 individual sacs, each having a cross-sectional area of from 1 to 20 $in^2$.

The side member may extend toward the back of the helmet in such a manner that an impact-release member may provide protection to the back of the batter's head. Said impact-release member may be separate from or continuous with the impact-release member near the batter's ear. It is within the scope of the invention that an impact-release member may only be at the back of the head.

Also, the side member can be fastened to the main helmet in many different ways. The manner of fastening should, on the one hand, be sufficiently loose that the side member can be readily adjusted to facilitate inserting a new impact-release member but, on the other hand, be sufficiently rigid that the side member does not move or shake as the batter moves his or her head. Typically, the side member will be positioned on the main helmet by several slot and strap arrangements and one or more snaps or gripping means, including hook and catch strap arrangements such as VELCRO® surfaces. The straps could each be from $\frac{1}{8}$ to $\frac{1}{2}$ inch wide and from $\frac{1}{2}$ to 3 inches long. In one embodiment of the invention the upper part of the side member is attached to the main helmet by a hinge means of from about $\frac{1}{2}$ to 2 inches in length.

The main helmet and the side member can be made from any of the known, substantially rigid materials used for batting helmets. Such materials include various polymers and co-polymers based upon polypropylene, polyethylene, and the like. It is within the scope of the invention that the side member could be comprised of a non-rigid material such as leather, vinyl, or a cloth-like weave or mesh.

Any of the known, conventional batting helmets, which have padding and/or webbing, could be used as the main helmet. The side member could be prepared by merely cutting an appropriately shaped piece from such a known helmet; however, it is preferred that the side member be comprised of a slightly stronger and/or heavier and/or rigid material. For example, the side member could be prepared from a slightly thicker and/or stronger plastic.

The impact-release, fluid-filled member could comprise virtually any material suitable for its purpose. First of all, any appropriate fluid may be used, water or air, especially air, being preferred. And secondly, the outside of said member is made from a material which will remain intact during normal use of a batting helmet but would rupture during impact by a baseball. Preferably the member, such as a sac, would be formed from an elastomeric material such as latex rubber. In fact, simple children's balloons which have been partly filled with air have been quite suitable.

It is preferred that the impact-release member be fixedly positioned between the main helmet and a side member. For example, one or more strips of a compressible material such as foam rubber could be mounted, preferably on the main helmet, to keep an impact-release member in position. Such strips could be from about $\frac{1}{8}$ to $\frac{3}{4}$ inches thick and from about $\frac{1}{4}$ to $\frac{3}{4}$ inches wide.

The concept that the impact-release member is fixedly positioned also encompasses this member being firmly held by the helmet and side member. The attachment means holding the side member to the helmet are arranged so that after the impact-release member is inserted, the interior surface of the side member and the exterior surface of the helmet compress the sides of the impact-release member. Advantageously the compressed impact-release member will have a width of from about $\frac{1}{2}$ to $\frac{1}{4}$ inches, particularly about $\frac{3}{4}$ inch.

In addition, it should be noted that the invention claimed herein has advantages that transcend mere impact release. When the impact-release member or members are in position, baseballs which hit the helmet either behind or in front of a impact-release member tend to ricochet off, more so than in conventional helmets. This increased tendency to ricochet, and to thus deflect impact from the batter's head, is a feature of the invention.

The invention can perhaps be better understood by making reference to the drawings. In FIG. 1, a conventional baseball batting helmet 1 has pairs of slots 2, at least one slot of each pair corresonding to a slot 3 in side member 4. Elastic strap members 5, $\frac{1}{4}$ inch wide by 1 inch long, in position, substantially secure side member 4 in position while permitting some movement relative to helmet 1.

Side member 4 is also secured to helmet 1 by snaps 6, the location of which can be seen better in FIG. 2. When the snaps are unfastened, side member 4 can be pulled away from helmet 1 to facilitate the insertion of air sac 7, which is held in position by foam rubber strip 8, which is about $\frac{1}{4}$ inch thick and about $\frac{1}{2}$ inch wide.

A comparison of FIGS. 3 and 4 demonstrates the invention before and after impact of a baseball. In FIG. 3, the air sac 7 contains sufficient air that there is an approximately one-inch space between the outer surface of helmet 1 and the inner surface of side member 4 and that elastic strap members 5 have stretched. Upon impact of the baseball, air sac 7 ruptures and elastic strap members 5 retract.

According to the embodiment of the invention shown in FIGS. 5 and 6, a helmet 21 has pairs of slots 22, at least one slot of each pair corresponding to a slot 23 in outer member 24. Elastic strap members 25, for example, $\frac{1}{4}$ inch wide by 1 inch long, in position, and snaps 26 substantially secure outer member 24 in position while permitting some movement relative to helmet 21. When the snaps 26 are unfastened, outer member 24 can be pulled away from helmet 21 to facilitate the insertion of air sacs 27, which are held in position by foam rubber strips 28, which are about $\frac{1}{4}$ inch thick and about $\frac{1}{2}$ inch wide. Air sacs 27 could comprise two separate sacs, which may or may not abut, or a single continuous sac.

In a further embodiment of the invention, not shown, a side member can be positioned adjacent to the helmet by a slide rod/spring coil means comprised of slide rod, slide rod receptacle, and a spring coil mechanism, whereby the slide rod would push against the spring coil means during impact by a baseball. Elastic strap members would be threaded through slits on the side member and corresponding slits on the helmet. An air sac could be held between the side member and the helmet, the distance between the inner surface of the side member and the outer surface of the helmet being approximately one inch.

In a yet further embodiment of the invention shown in FIG. 7, the helmet may have a face shielding means, or face shield 30, that attaches to the front of the helmet 1. The face shield 30 should be of sufficient dimensions that it covers from about 25 to 100 percent, preferably from about 35 to 80 percent, of the batter's exposed face area, it being primarily important to cover the eyes, upper cheek bones, and to cover the eyes and as much of the nose as possible. The face shield 30, which should be comprised of lightweight, transparent shatter-proof or impact-resistant, thermoplastic material, is preferably attached by hinge, snap, swivel, or other gripping means 31 to the helmet visor 32 and by snaps or other gripping means 33 to the lateral surfaces of the helmet 1, most preferably on the forward surfaces thereof. This configuration should allow the face shield 30 to be flipped up when desired, such as when the helmet 1 is put on or removed.

The principles described above are also applicable to other types of helmets, such as football helmets, hockey helmets, or construction helmets. With regard to a construction helmet, it is envisioned that such a helmet would have a circular or oval top member over-laying the helmet, which top member would have an impact-absorbing member between the top member and the helmet itself. The top member would be attached at several points to the helmet, preferably by simple snaps or slot and strap arrangements.

It should also be pointed out that the invention herein might very well be applicable to shielding other portions of the body from injury. For example, a bullet-proof vest could comprise a large, thin air-filled sac adjacent to the wearer's body. The air-filled sac would not be intended to stop a bullet but merely to disperse the forces resulting from the impact of a bullet upon an outer, bullet-resistent layer. Such an air-filled sac would preferably have some sort of surface adjacent to the wearer's body that would prevent the wearer from rupturing the sac during the course of normal wear. In addition, the sac could comprise a layer of one or more air-filled sacs.

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. In an improved baseball batting helmet comprising an outer shell which has front and rear portions and inner and outer surfaces, which projects over at least one of a batter's ears, and which has webbing and/or padding on the inner surface of the shell to cushion the helmet against the batter's head, the improvement wherein the helmet has an outer member adjacent to at least one side of the outer shell, an impact-release member is position between the outer surface of the shell and the inner surface of the outer member, the impact-release member comprising a fluid-filled sac which has sufficient cross-sectional area to substantially cover the ear and/or temple area of the batter's head and which ruptures upon impact of a projectile upon the helmet, and the outer member is attached to the outer shell by attachment means at two or more points of attachment, each point of attachment being located sufficiently far from the center of the outer member that portions of the outer member not directly above the fluid-filled sac are flexible and act to deflect objects which may strike the helmet on one of said portions.

2. The helmet of claim 1, wherein the attachment means are slot and strap arrangements and/or snap means.

3. The helmet of claim 1, wherein the outer member is attached to the shell in such a manner that the impact-release member can be replaced.

4. The helmet of claim 1, wherein the impact-release member comprises a water-filled latex rubber sac.

5. The helmet of claim 1, wherein the impact-release member comprises an air-filled latex rubber sac.

6. The helmet of claim 1, wherein the outer member projects over the rear portion of the outer shell and an impact-release member covers the rear of the batter's head.

7. The helmet of claim 6, wherein one impact-release member covers the ear and/or temple area and the rear of the batter's head.

8. The helmet of claim 6, wherein one impact-release member covers the ear and/or temple area and a second impact-release member covers the rear of the batter's head.

9. The helmet of claim 1, wherein a face shield is secured at one or more places to the frontal portion of the helmet, the face shield being arranged so as to cover from about 25 to 100 percent of the batter's exposed face area.

10. The helmet of claim 9, wherein the face shield is secured to a visor of the helmet by hinge means and by snap, strap, and/or gripping means to the frontal portion of each lateral surface of the helmet.

* * * * *

UNITED STATES PATENT AND TRADEMARK OFFICE

CERTIFICATE OF CORRECTION

PATENT NO. : 4,660,230

DATED : April 28, 1987

INVENTOR(S) : Rudolf M. Mayling

It is certified that error appears in the above-identified patent and that said Letters Patent is hereby corrected as shown below:

Column 4, line 10, "and to cover the eyes and as much" should read

-- and as much --.

Column 4, line 59, Claim 1, "position" should read -- positioned --.

Signed and Sealed this

Twenty-fifth Day of August, 1987

*Attest:*

DONALD J. QUIGG

*Attesting Officer*

*Commissioner of Patents and Trademarks*